US008511429B1

(12) United States Patent
Yu et al.

(10) Patent No.: US 8,511,429 B1
(45) Date of Patent: Aug. 20, 2013

(54) CEILING PANELS MADE FROM CORRUGATED CARDBOARD

(75) Inventors: Qing Claire Yu, Libertyville, IL (US); Mark Englert, Libertyville, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/371,886

(22) Filed: Feb. 13, 2012

(51) Int. Cl.
*E04B 1/84* (2006.01)

(52) U.S. Cl.
USPC ..... 181/290

(58) Field of Classification Search
USPC ..... 181/284, 290, 293, 295
See application file for complete search history.

(56) References Cited

U.S. PATENT DOCUMENTS

| | | | | | |
|---|---|---|---|---|---|
| 1,894,592 | A | * | 1/1933 | Kilmer | 52/407.3 |
| 1,925,453 | A | * | 9/1933 | Mazer | 181/290 |
| 1,972,592 | A | * | 9/1934 | Jacobson | 181/292 |
| 2,132,642 | A | * | 10/1938 | Parsons | 428/137 |
| 2,308,869 | A | * | 1/1943 | Eckardt | 181/291 |
| 2,419,971 | A | * | 5/1947 | Rumpf et al. | 428/188 |
| 2,840,179 | A | | 6/1958 | Junger | |
| 3,035,657 | A | | 5/1962 | Lemon | |
| 3,176,789 | A | * | 4/1965 | Lighter | 181/290 |
| 3,308,006 | A | * | 3/1967 | Kresse et al. | 428/186 |
| 3,380,206 | A | * | 4/1968 | Barnett | 52/145 |
| 4,301,890 | A | * | 11/1981 | Zalas | 181/286 |
| 4,496,024 | A | * | 1/1985 | Wolf et al. | 181/292 |
| 4,522,284 | A | | 6/1985 | Fearon et al. | |
| 4,529,637 | A | | 7/1985 | Hankel | |
| 4,641,726 | A | | 2/1987 | Fearon et al. | |
| 4,807,411 | A | | 2/1989 | Capaul | |
| 4,886,696 | A | * | 12/1989 | Bainbridge | 428/184 |
| 4,909,003 | A | | 3/1990 | Hennigan | |
| 5,022,943 | A | * | 6/1991 | Zaima | 156/222 |
| 5,545,458 | A | * | 8/1996 | Fukushima et al. | 428/117 |
| 6,179,086 | B1 | | 1/2001 | Bansemir et al. | |
| 6,244,378 | B1 | | 6/2001 | McGrath | |
| 6,256,959 | B1 | * | 7/2001 | Palmersten | 52/588.1 |
| 6,983,821 | B2 | | 1/2006 | Putt et al. | |
| 7,837,009 | B2 | | 11/2010 | Gross et al. | |
| 2009/0250291 | A1 | * | 10/2009 | Sparks et al. | 181/290 |

* cited by examiner

*Primary Examiner* — Jeremy Luks
(74) *Attorney, Agent, or Firm* — Pearne & Gordon LLP

(57) ABSTRACT

An acoustical ceiling panel comprising a flat core and an acoustically transparent face sheet adhesively attached to one of two oppositely facing major sides of the core, the core comprising a multitude of layers of corrugated fiberboard laminated together, the corrugated fiberboard layers each having a corrugated medium adhesively attached to a flat liner board, the corrugated medium forming regularly spaced flutes of curvilinear cross-section, the flutes of the layers of fiberboard being arranged in parallel directions extending perpendicularly to the major faces of the core.

5 Claims, 2 Drawing Sheets

CEILING PANELS MADE FROM CORRUGATED CARDBOARD

BACKGROUND OF THE INVENTION

The invention relates to building products and, in particular, to acoustical ceiling tile.

PRIOR ART

Suspended ceilings customarily comprise a suspended metal grid and panels or tiles closing the spaces between the grid elements. Normally, the panels are constructed with selected materials and/or surface treatments to absorb sound. The ability of a panel to absorb sound is conventionally reported as its Noise Reduction Coefficient or NRC. NRC can range between 0 (no absorption) and 1 (full absorption) with a rating of 0.5, meaning it absorbs 50% of the sound energy striking it, being required to qualify a panel as "acoustical". In the industry, panels rated at 0.7 are considered to have good acoustical performance. A need exists for acoustical tiles that achieve excellent NRC values and especially have the ability to absorb sound at target frequencies, have a high post consumer recycle content, resist sagging over time, are relatively light in weight, and are relatively inexpensive to produce.

SUMMARY OF THE INVENTION

The invention provides a ceiling panel with high level acoustical absorption properties using a core made of ordinary corrugated fiberboard, sometimes called cardboard. The core construction consists of numerous narrow strips of corrugated fiberboard laminated together. The corrugated board is cut perpendicular to the corrugations or flutes so that the flute openings lie in front and back planes of the panel core corresponding to the geometry of the finished panel. The front of the panel is covered with a suitable sheet of acoustically transparent material with proper air flow resistance and the back of the panel is optionally closed with another sheet, preferably with acoustical isolating properties.

In addition to high acoustical performance, the panel of the invention has the potential to be economically produced, light in weight, and have a high post-consumer recycle content. Corrugated fiberboard is typically produced on high speed machines with relatively low energy consumption and with high recycled paper content. Because the inventive panel is largely air space, it is relatively light in weight.

The disclosed vertical orientation of a flat liner board component of the corrugated fiberboard in the finished panel makes the panel sag resistant and capable of spanning large grid modules. The inventive panel can be produced directly from reclaimed corrugated fiberboard since there is no criticality in the uniformity of the flute size, flute alignment, and/or number of walls of the corrugated fiberboard used in a particular panel.

DESCRIPTION OF THE PREFERRED EMBODIMENT

Figure 1:
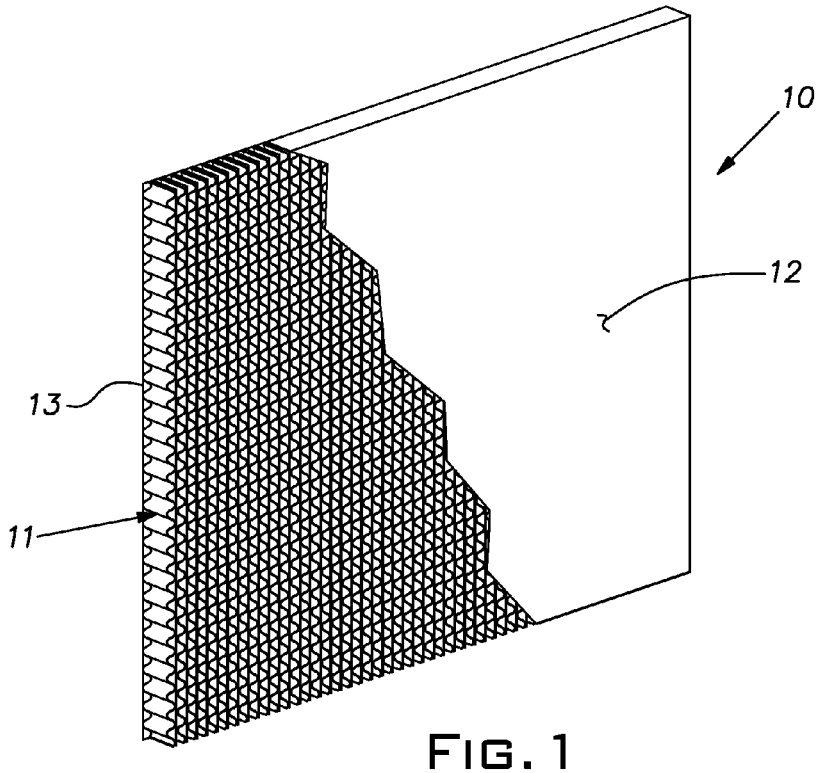
FIG. 1 is a perspective view of an acoustical panel made in accordance with the present invention.

FIG. 1 illustrates an example of an acoustical ceiling panel 10 of the invention; the panel is a nominal 2 foot by 2 foot unit and can have a nominal thickness of 1 inch. Dimensions discussed herein will be understood to include industry metric equivalents. The panel 10 includes a corrugated fiberboard core 11, a face sheet 12, and a backing sheet 13. The core 11 is made by assembling numerous corrugated fiberboard layers 15 side-to-side such that the combined total thickness of the layers is equal to the length of an edge of the panel 10.

Figure 2:
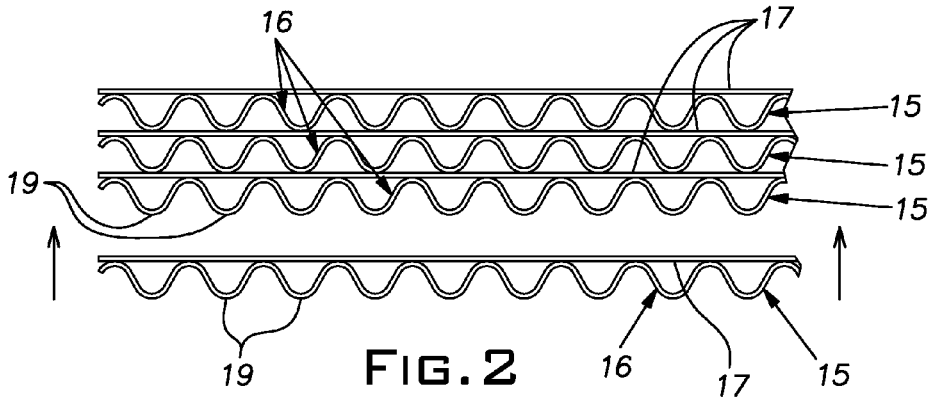
FIG. 2 is a fragmentary schematic showing of one manner of assembling a core of the inventive panel.

As shown in FIG. 2, each layer 15 can comprise a corrugated medium 16 and a single flat liner board 17, the combination of these elements sometimes being referred to as a single-sided or single face corrugated board. The paper compositions and fabrication of corrugated fiberboard is well known to the relevant industry. The corrugated medium 16 is a paper, typically, in the United States having a weight of 0.026 lbs./square foot. The paper is heated, moistened and formed into a fluted pattern on geared wheels. Typically, the fluted or corrugated medium 16 is joined to the flat liner board 17 with a starch-based adhesive to form the single face board comprising the layer 15. As is typical, the liner board stock can have the same weight as the paper of the medium 16. The flutes or corrugations of the medium 16 are essentially entirely curvilinear in cross-section and resemble a sine wave. The size of the flutes, designated 19, is ordinarily stated by the number of flutes in a foot length of the corrugated fiberboard. ASTM Standard D4727 sets out the following flute sizes, applicable to single face, as well as singlewall, doublewall and triplewall corrugated fiberboard (referred to below).

| | Flutes/ft | Flutes/m | Flute Height (in.) | Flute Height (mm) |
|---|---|---|---|---|
| A-Flute | 30 to 39 | 98 to 128 | 0.1575 to 0.2210 | 4.00 to 5.61 |
| B-Flute | 45 to 53 | 147 to 174 | 0.0787 to 0.1102 | 2.00 to 2.80 |
| C-Flute | 35 to 45 | 115 to 148 | 0.1300 to 0.1575 | 3.30 to 4.00 |
| E-Flute | 70 to 98 | 229 to 321 | 0.0445 to 0.0550 | 1.13 to 1.40 |

Tests have indicated good acoustical properties, with an NRC in the order of 0.70, can be obtained with all of these standard flute sizes. Moreover, the panel construction, such as the panel thickness, can be selected to absorb sound at targeted frequencies.

By way of example, the thickness of the corrugated fiberboard core can be, as mentioned above, nominally 1 inch. FIG. 2 schematically illustrates one method of manufacturing the core 11. Single face stock or board 15, i.e. having only one flat liner board 17 and one corrugated medium 16, is slit into 1 inch wide strips. The length of the strips can be equal to one of the nominal planar dimensions of the finished panel 10. The strips are stacked on each other with their longitudinal slit edges in registration. Glue or adhesive is applied to a side of a strip at the interface between adjacent strips. The stack height is built up until it reaches the nominal planar dimension of the finished panel perpendicular to that represented by the length of the laminated strips.

Figure 3:
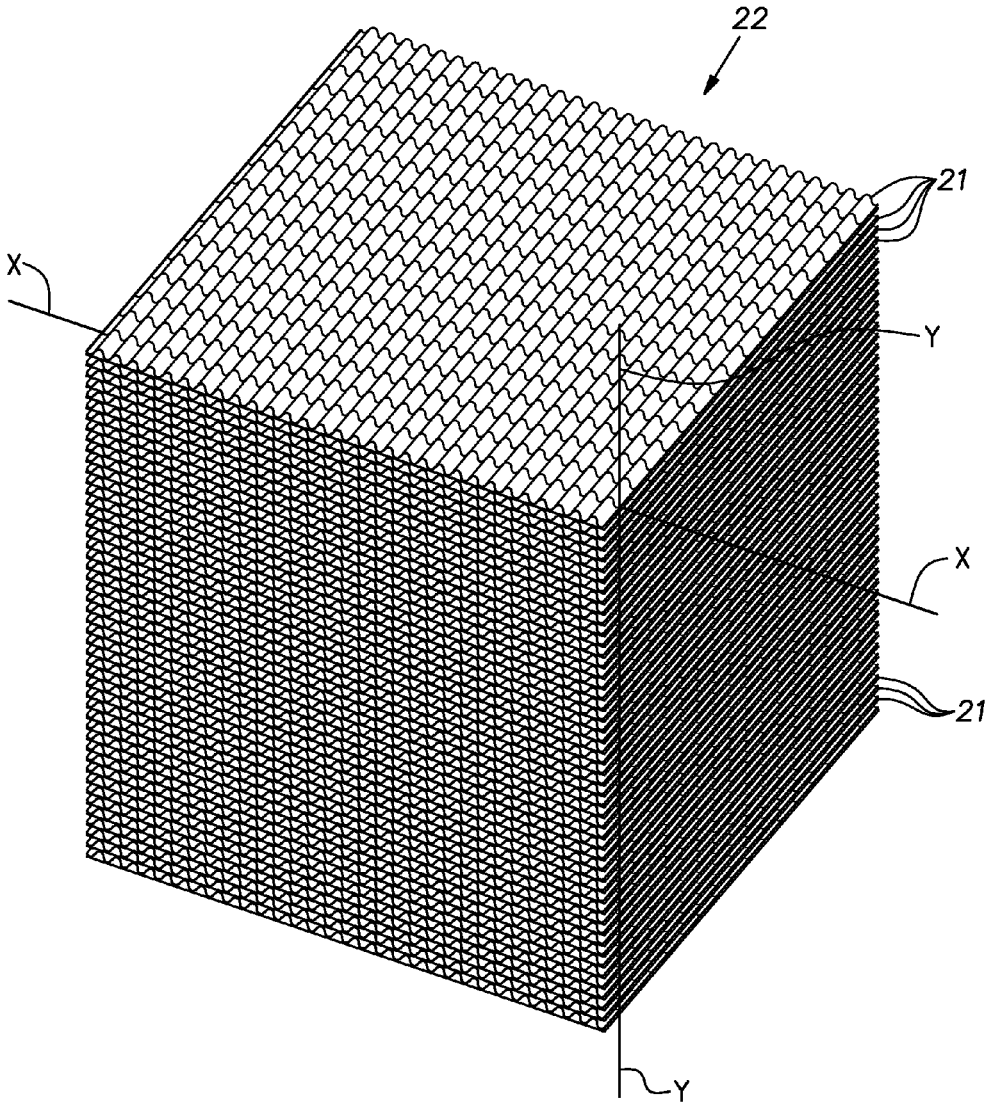
FIG. 3 is a perspective view of a three-dimensional block from which the inventive panels are cut in an alternative manner of producing a core of the inventive panel.

FIG. 3 illustrates another method of forming the core 11. Flat rectangular sheets 21 of corrugated fiberboard having at least one planar dimension equal to a nominal planar dimension of the finished panel 10 are stacked to a height equal to the other nominal planar dimension of the panel. The sheets are permanently attached to one another with glue or adhesive at their interfaces. The result is a block 22, which in the illustration of FIG. 3 is a cube. The block 22 is sliced with a saw along a plane denoted by lines X-X and Y-Y spaced nominally 1 inch from a side of the block to form a core. Successive cores 11 are formed by more cuts, each spaced a distance of 1 inch from the preceding cut.

The flutes 19 of the core 11 extend perpendicularly to its major planar faces. The face sheet 12 is an acoustically transparent medium or film, optionally painted with proper air flow resistance that can serve as the appearance side visible to an observer in a room in which the panel 10 is installed. The face sheet 12 is adhered to the core 11 with a suitable adhesive. The face sheet 12 can be coated with a paint of a type used on the face of conventional ceiling tiles to improve its appearance and/or light reflectance and to obtain overall air flow resistance in a proper range. An example of a suitable face sheet 12 is a non-woven fabric such as fiberglass scrim with a caliper of 0.02 inch, basis weight of 125 $g/m^2$, and specific air flow resistance of 45.6 Pa·s/m coated with a paint.

The choice of face sheet 12 with proper air flow resistance was found to be important to the overall acoustical performance of the inventive panel; if the air flow resistance is too low or too high, the acoustical performance is impaired.

The side of the core 11 opposite the facing sheet 12 is preferably covered with the backing sheet 13 which can be a kraft paper laminated with a metal foil as used in some commercially available ceiling tile products. Other non-foiled paper can be used for the backing sheet 13. The backing sheet 13 can be used to obtain a good CAC (Ceiling Attenuation Class) value. A suitable adhesive is used to attach the backing sheet 13 to the core 11.

The single face board 15 illustrated most clearly in FIG. 2 is the most efficient corrugated fiberboard style from a material usage standpoint. As shown in FIG. 2, the flat liner board 17 of one board 15 can serve as a liner board of an adjacent single face board when it is adhesively attached thereto. From an acoustical standpoint, singlewall, doublewall and triplewall corrugated fiberboard work satisfactorily and can be used in place of the illustrated single face board 15. It is contemplated that where there is a reliable source of used quality corrugated fiberboard stock is available, the core 11 can be made by reclaiming this used material and converting it directly into a core. Since the standard flute ranges are comparable in acoustical performance in a core construction, it is possible to produce a core with mixed flute sizes and without layer to layer flute registration. This flute size and registration free compatibility can make use of reclaimed corrugated fiberboard stock in the manufacture of the inventive panel 10 more practical.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An acoustical ceiling panel comprising a flat core and an acoustically transparent face sheet adhesively attached to one of two oppositely facing major sides of the core, the core comprising a multitude of layers of corrugated fiberboard laminated together, the corrugated fiberboard layers each having a corrugated medium adhesively attached to a flat liner board, the corrugated medium forming regularly spaced flutes of curvilinear cross-section, sidewalls of the flutes being perpendicular to the face sheet, the flutes of the layers of fiberboard being arranged in parallel directions extending perpendicularly to the major faces of the core, the core having major face dimensions of 2 foot by 2 foot or 2 foot by 4 foot and a nominal thickness of about 1 inch, the face sheet being a non-woven scrim painted to achieve an air flow resistance that allows the panel to exhibit an NRC of about 0.7.

2. An acoustical ceiling panel as set forth in claim 1, wherein the side of the core opposite the side covered by the face sheet is covered by a backing sheet adhesively attached to the core for improving CAC.

3. An acoustical ceiling panel as set forth in claim 1, wherein the individual laminations of corrugated fiberboard are all single sided.

4. An acoustical ceiling panel as set forth in claim 1, wherein the flutes are selected from one or more of A, B, C and E flutes described in ASTM Standard D4727.

5. An acoustical ceiling panel as set forth in claim 1, wherein the flutes have a size between 30 per foot with a height of 0.2210 inches and 98 per foot with a height of 0.0445 inches.

* * * * *